US010808688B1

(12) United States Patent
Raghavan et al.

(10) Patent No.: US 10,808,688 B1
(45) Date of Patent: Oct. 20, 2020

(54) HIGH PRESSURE PUMPS HAVING A CHECK VALVE KEEPER AND ASSOCIATED SYSTEMS AND METHODS

(71) Applicant: OMAX Corporation, Kent, WA (US)

(72) Inventors: Chidambaram Raghavan, Seattle, WA (US); Darren Stang, Covington, WA (US); Craig Rice, Federal Way, WA (US)

(73) Assignee: OMAX Corporation, Kent, WA (US)

( * ) Notice: Subject to any disclaimer, the term of this patent is extended or adjusted under 35 U.S.C. 154(b) by 434 days.

(21) Appl. No.: 15/641,087

(22) Filed: Jul. 3, 2017

(51) Int. Cl.

| | |
|---|---|
| ***F04B 39/10*** | (2006.01) |
| ***F04B 39/12*** | (2006.01) |
| ***F04B 1/182*** | (2020.01) |
| ***F04B 1/16*** | (2006.01) |
| ***F04B 53/10*** | (2006.01) |

(Continued)

(52) U.S. Cl.
CPC ..... *F04B 39/1006* (2013.01); *F04B 1/16* (2013.01); *F04B 1/182* (2013.01); *F04B 1/184* (2013.01); *F04B 39/1066* (2013.01); *F04B 39/121* (2013.01); *F04B 39/122* (2013.01);
(Continued)

(58) Field of Classification Search
CPC .. F04B 39/1006; F04B 39/1066; F04B 1/053; F04B 1/0538; F04B 1/16; F04B 1/182; F04B 1/184; F04B 53/008; F04B 53/007; F04B 53/1002; F04B 53/101; F04B 53/1012; F04B 53/166
See application file for complete search history.

(56) References Cited

U.S. PATENT DOCUMENTS 2,340,975 A 4/1941 Morgan
2,386,675 A * 10/1945 Ford ..... F04B 1/126 417/269

(Continued)

FOREIGN PATENT DOCUMENTS

CN 201650635 U 11/2010
CN 201827039 U 5/2011

(Continued)

OTHER PUBLICATIONS

"Memory water jet milling," available from http://www.computescotland.com/memory-water-jet-milling-5236.php, Apr. 24, 2012, 4 pages.

(Continued)

*Primary Examiner* — Bryan M Lettman
*Assistant Examiner* — Timothy P Solak
(74) *Attorney, Agent, or Firm* — Perkins Coie LLP

(57) ABSTRACT

High pressure pumps and associated check valves for use with, e.g., waterjet systems, are disclosed herein. In some embodiments, high pressure pumps configured in accordance with the present disclosure include check valve assemblies that eliminate threaded parts for restricting the motion of check valve components which are subjected to very high pressure variations at relatively high frequencies. Additionally, embodiments of the pumps described herein can include unitary structures that integrate the individual parts associated with multiple cylinders (e.g., cylinders, check valve bodies, etc.) into a single part (e.g., a cylinder manifold, check valve manifold, outlet manifold, etc.) that can substantially reduce the number of different parts required to assemble the pump.

20 Claims, 11 Drawing Sheets

(51) Int. Cl.
*F04B 1/184* (2020.01)
*F04B 53/00* (2006.01)
*F04B 53/16* (2006.01)

(52) U.S. Cl.
CPC ..... *F04B 39/125* (2013.01); *F04B 53/007* (2013.01); *F04B 53/1002* (2013.01); *F04B 53/16* (2013.01)

(56) References Cited

U.S. PATENT DOCUMENTS 2,399,571 A * 4/1946 Porter ..... F04B 27/005 417/34
2,463,552 A 3/1949 Newhall
2,550,435 A 4/1951 Willke
2,570,698 A 10/1951 Manseau
2,819,835 A 1/1958 Newhall
2,833,220 A * 5/1958 Robinson ..... F04B 5/02 417/418
3,114,326 A 12/1963 Yaindl
3,373,695 A 3/1968 Yohpe
3,427,988 A 2/1969 Redman et al.
3,614,265 A 10/1971 Ohrberg
3,692,214 A * 9/1972 Liedberg ..... B05B 7/2489 222/334
3,702,624 A 11/1972 Fries
3,746,483 A 7/1973 Hindel et al.
4,029,440 A 6/1977 Olsen
4,048,841 A 9/1977 Kent
4,050,862 A 9/1977 Buse
4,102,611 A 7/1978 Broker
4,146,355 A 3/1979 Broker et al.
4,173,435 A 11/1979 Harnmelmann
4,184,817 A 1/1980 Pareja
4,195,970 A 4/1980 Zalis
4,428,275 A 1/1984 Huperz et al.
4,477,237 A 10/1984 Grable
4,494,415 A 1/1985 Elliston
4,527,957 A 7/1985 Dellinger et al.
4,536,135 A 8/1985 Olsen et al.
4,556,371 A 12/1985 Post
4,566,370 A 1/1986 Hanafi
4,616,983 A 10/1986 Hanafi
4,634,353 A 1/1987 Huperz
4,687,426 A 8/1987 Yoshimura
4,729,720 A 3/1988 Fujita
4,762,051 A 8/1988 Besic et al.
4,764,394 A 8/1988 Conrad
4,776,769 A 10/1988 Hilaris
4,780,064 A 10/1988 Olsen
4,790,732 A 12/1988 Yamatani
4,878,815 A 11/1989 Stachowiak
4,893,753 A 1/1990 Munoz et al.
4,960,039 A 10/1990 Robertson
5,102,312 A 4/1992 Harvey
5,198,285 A 3/1993 Arai et al.
5,317,873 A 6/1994 Okuda et al.
5,337,561 A 8/1994 Raghavan et al.
5,411,380 A 5/1995 Bristol et al.
5,577,390 A 11/1996 Kaido et al.
5,771,873 A 6/1998 Potter et al.
5,800,134 A 9/1998 Hasegawa et al.
5,975,864 A 11/1999 De Santis et al.
6,139,288 A 10/2000 Karasawa
6,152,014 A 11/2000 Willimczik
6,171,070 B1 1/2001 Mitake
6,241,492 B1 6/2001 Pacht
6,264,439 B1 7/2001 Falk et al.
6,443,705 B1 9/2002 Munoz
6,454,548 B2 9/2002 Falk et al.
6,548,173 B2 4/2003 Erdemir et al.
6,622,612 B2 9/2003 Notzon
6,632,324 B2 10/2003 Chan
6,802,541 B2 * 10/2004 Hopinks ..... F04B 53/16 285/334.1
6,893,720 B1 5/2005 Nakahigashi et al.
6,913,447 B2 7/2005 Fox et al.
6,919,288 B2 7/2005 Yamamoto et al.
6,960,069 B2 11/2005 Maruta et al.
6,970,793 B2 11/2005 Pearson et al.
6,979,125 B2 12/2005 Vicars
7,073,611 B2 7/2006 Sui et al.
7,121,812 B2 10/2006 Forrest
7,134,851 B2 11/2006 Chenoweth
7,165,396 B2 1/2007 Zumbusch
7,568,424 B2 8/2009 Hopkins et al.
7,905,711 B2 3/2011 Mochizuki et al.
8,267,672 B2 9/2012 Kellar et al.
8,322,997 B2 12/2012 Auer et al.
8,664,084 B2 3/2014 Deguet et al.
9,003,955 B1 4/2015 Stang et al.
9,273,682 B2 3/2016 Stang et al.
9,810,205 B2 11/2017 Raghavan et al.
2001/0048883 A1 12/2001 Falk et al.
2005/0074350 A1 * 4/2005 Raghavan ..... F04B 53/007 417/569
2005/0121312 A1 6/2005 Sui et al.
2007/0009367 A1 1/2007 Tischler et al.
2008/0000065 A1 1/2008 Ganguly et al.
2008/0019851 A1 1/2008 Hopkins et al.
2009/0101730 A1 * 4/2009 Davis ..... A01M 1/2077 239/44
2009/0272245 A1 11/2009 Voice et al.
2009/0311944 A1 12/2009 Olsen
2010/0166573 A1 7/2010 Magami et al.
2010/0310384 A1 12/2010 Stephenson et al.
2010/0326271 A1 12/2010 Stang
2012/0186518 A1 7/2012 Pierre et al.
2012/0201706 A1 8/2012 Liu et al.
2012/0272764 A1 11/2012 Pendleton
2013/0112074 A1 5/2013 Small
2013/0167697 A1 * 7/2013 Reukers ..... B26F 3/004 83/53

FOREIGN PATENT DOCUMENTS

CN 102632373 A 8/2012
GB 1078145 A 8/1967
JP 62055112 A1 3/1987

OTHER PUBLICATIONS

Nendzig, Gerhard, English language translation of "Vier ist besser als drei?!, Oszillierende Verdrangerpumpen unter der Lupe," CAV Oct. 2007, www.cav.de, 6 pages.
KIPO ISA/KR, International Search Report and Written Opinion for International Application No. PCT/US2015/012054 filed Jan. 20, 2015, dated Apr. 29, 2015, 19 pages.

* cited by examiner

HIGH PRESSURE PUMPS HAVING A CHECK VALVE KEEPER AND ASSOCIATED SYSTEMS AND METHODS

TECHNICAL FIELD

The present disclosure is generally related to high pressure pumps and, more specifically, to high pressure pumps and associated check valves having increased fatigue life and reduced complexity.

BACKGROUND

There are various commercial and industrial uses for high pressure fluid pump systems operating at pressures of greater than 10,000 psi. Such systems can be used in, for example, fluid-jet cutting systems, fluid-jet cleaning systems, etc. In conventional fluid-jet cutting systems (e.g., waterjet or abrasive-jet systems), the fluid most frequently used to form the jet is water, and the high-velocity jet may be referred to as a "water jet" or "waterjet." In operation, waterjet systems typically direct a high-velocity jet of water toward a workpiece to rapidly erode portions of the workpiece. Abrasive material can be added to the fluid to increase the rate of erosion. When compared to other shape-cutting systems (e.g., electric discharge machining (EDM), laser cutting, plasma cutting, etc.), waterjet systems can have significant advantages. For example, waterjet systems often produce relatively fine and clean cuts, typically without heat-affected zones around the cuts. Waterjet systems also tend to be highly versatile with respect to the material type of the workpiece. The range of materials that can be processed using waterjet systems includes very soft materials (e.g., rubber, foam, leather, and paper) as well as very hard materials (e.g., stone, ceramic, and hardened metal). Furthermore, in many cases, waterjet systems are capable of executing demanding material-processing operations while generating little or no dust, smoke, and/or other potentially toxic byproducts.

In a typical waterjet system, a pump pressurizes water to a high pressure (e.g., up to 60,000 psi or more), and the water is routed from the pump to a cutting head that includes an orifice. Passing the water through the orifice converts the static pressure of the water into kinetic energy, which causes the water to exit the cutting head as a jet at high velocity (e.g., up to 2,500 feet per second or more) and impact a workpiece. In many cases, a jig supports the workpiece. The jig, the cutting head, or both can be movable under computer and/or robotic control such that complex processing instructions can be executed automatically. Waterjet systems often use direct drive, positive displacement pumps (e.g., crankshaft-driven plunger pumps) to provide the high pressure liquid for precision cutting, shaping, carving, reaming, and other material-processing applications.

FIG. 1A is a partially exploded isometric view of a high pressure pump 100 suitable for use in a conventional waterjet system. The pump 100 is a conventional three cylinder pump having three sets of individual cylinder components mounted to a common crankcase 102. The individual cylinder components can include, for example, cylinders 106 (identified individually as cylinders 106*a-c*), check valve assemblies 108 (identified individually as check valve assemblies 108*a-c*), and an end caps 110 (identified individually end caps 110*a-c*). Each cylinder 106 includes a cylindrical interior volume that defines a corresponding compression chamber 107. The pump 100 further includes three reciprocating plunger assemblies 112 (identified individually as plunger assemblies 112*a-c*) which are operably coupled to a crankshaft 104 in a conventional manner. Each of the plunger assemblies 112 includes a corresponding plunger rod 114 that is operably received in a corresponding compression chamber 107.

FIG. 1B is an enlarged exploded isometric view of the check valve assembly 108, and FIG. 1C is an enlarged cross-sectional view of the check valve assembly 108. Referring to FIGS. 1B and 1C together, the check valve assembly 108 includes a body 120 that carries an inlet check valve 122*a* and a corresponding outlet check valve 122*b*. Each of the check valves 122 includes a valve seat 130 and a corresponding ball 128 housed in a retainer 126 that is held in the body 120 by a threaded retainer nut 124.

Referring to FIGS. 1A-1C together, the pump 100 operates in a conventional manner to pressurize liquid (e.g., water) to pressures of 60,000 psi or more for use in a waterjet system. More specifically, an engine or electric motor (not shown) can rotate the crankshaft 104, causing each of the plunger rods 114 to sequentially retract in its corresponding cylinder 106 and draw relatively low pressure liquid (e.g., water) into the associated compression chamber 107 via the inlet check valve 122*a* (FIGS. 1B-1C). As the crankshaft 104 drives the plunger rod 114 back up in the cylinder 106, it compresses the liquid. Once the liquid pressure in the compression chamber 107 exceeds the pressure on the backside of the outlet check valve 122*b*, the outlet check valve 122*b* opens and allows the high pressure liquid to flow from the compression chamber 107 and through the corresponding end cap 110 to an outlet manifold 116.

In conventional high pressure direct drive pumps like that shown in FIGS. 1A-1C, the internal pressures within the compression chambers 107 can vary from 0 up to, for example, 75,000 psi or more, and this pressure variation can occur at a frequencies of, for example, 2 to 100 Hz. This rapid cycling of very high pressure variations can lead to fatigue of pump parts and premature failure. The threaded retainer nuts 124 (FIGS. 1B and 1C), which restrict motion of the check valve components, are especially prone to fatigue failure, resulting in costly and time-consuming downtime for replacement and/or maintenance. An additional shortcoming of conventional multi-cylinder high pressure direct drive pumps is that, as shown in FIG. 1A, they typically include multiple sets of individual components associated with each cylinder. The use of multiple part assemblies can increase the difficulty of assembly due to the number of loose parts, manufacturing tolerances, and other factors. Accordingly, it would be advantageous to provide a high pressure pump, such as a high pressure direct drive pump suitable for use in waterjet systems, that overcomes the foregoing disadvantages associated with conventional high pressure direct drive pumps.

DETAILED DESCRIPTION

Figure 1A:
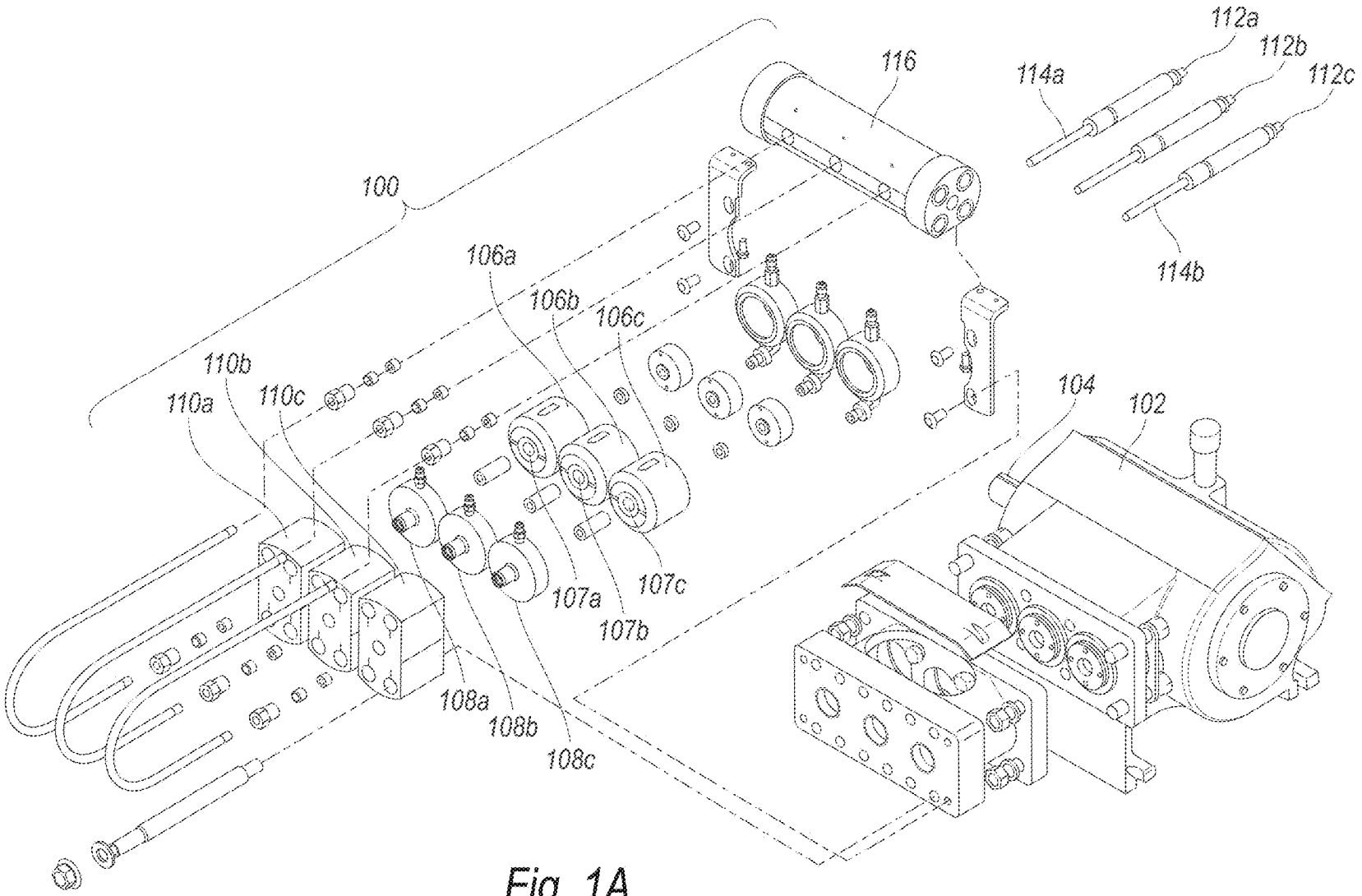
Fig. 1A (PRIOR ART)
FIG. 1A is a partially exploded isometric view of a high pressure direct drive pump configured in accordance with the prior art.
Figure 1C:
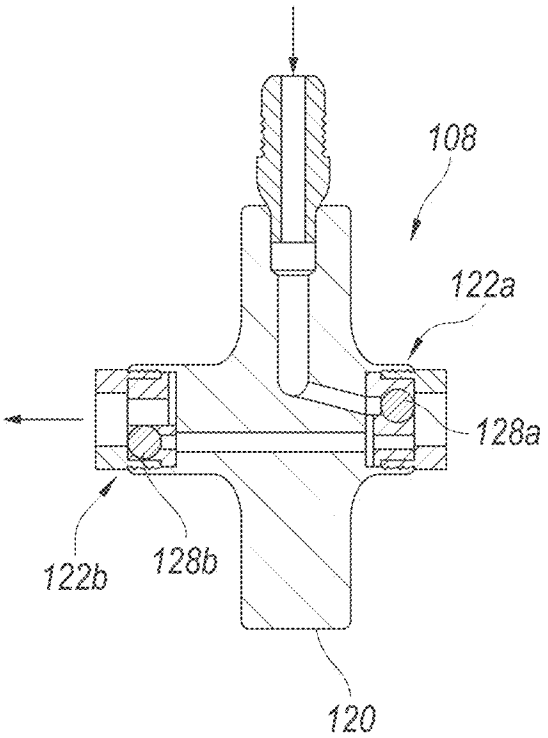
Fig. 1C (PRIOR ART)
FIGS. 1B and 1C are an enlarged exploded isometric view and a cross-sectional view, respectively, of a check valve assembly configured in accordance with the prior art.
Figure 1B:
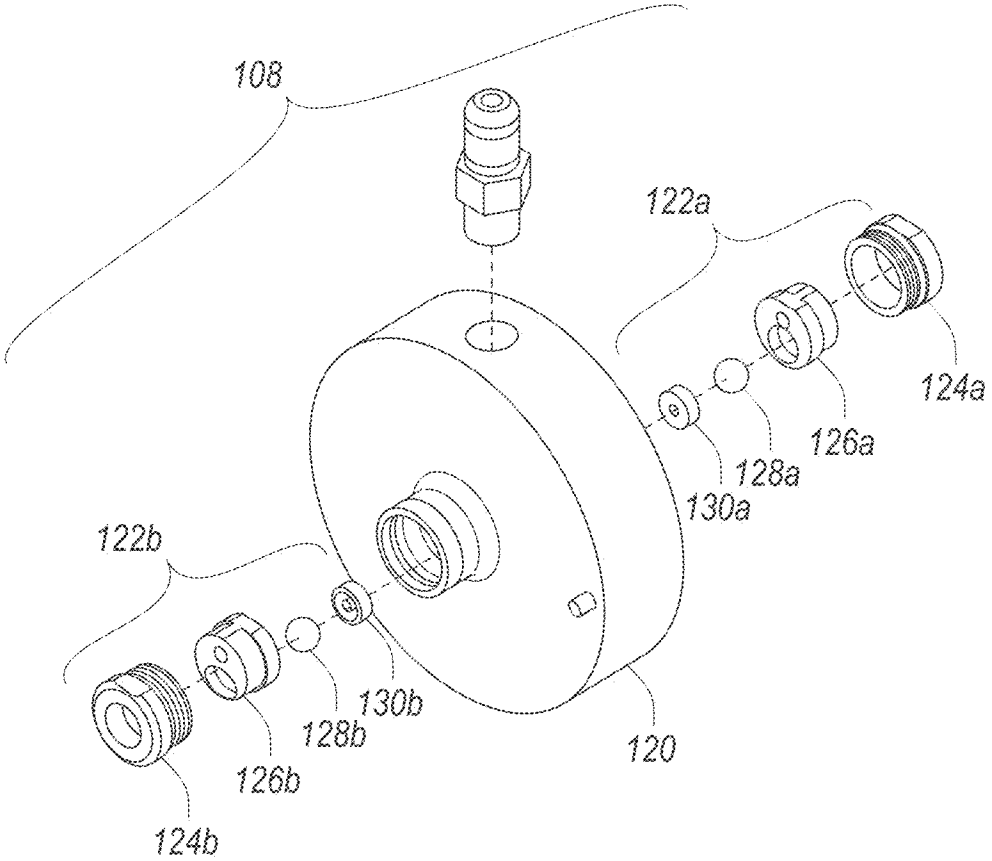
Fig. 1B (PRIOR ART)

The following disclosure describes various embodiments of high pressure pumps having simplified check valve assemblies that alleviate or at least substantially reduce the fatigue problems commonly associated with conventional high pressure pumps. For example, in some embodiments high pressure pumps configured in accordance with the present disclosure can include check valve assemblies that eliminate threaded parts for restricting the motion of check valve components which are subjected to very high pressure variations at relatively high frequencies. Additionally, embodiments of the pumps described herein can greatly reduce the number of different parts required to assemble the pump by integrating a number of individual parts (e.g., cylinders, check valve bodies, etc.) into a single, unitary part. Although in some instances the single part may be more complex than the individual parts, once the design and manufacturing of such parts has been developed (and, for example, programmed into the associated manufacturing tools), the parts can be manufactured with less set-ups and the net cost to manufacture the parts comes down as compared to conventional pumps having multiple part assemblies.

Certain details are set forth in the following description and in FIGS. 1A-7B to provide a thorough understanding of various systems and methods embodying this fluid pressurizing innovation. Other details describing well-known aspects of pressurizing devices and systems (e.g., direct drive, positive displacement plunger pump systems, etc.), waterjet systems, etc. are not set forth in the following disclosure, however, to avoid unnecessarily obscuring the description of the various embodiments. The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the invention.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below. In the Figures, identical reference numbers identify identical, or at least generally similar, elements. To facilitate the discussion of any particular element, the most significant digit or digits of any reference number refers to the Figure in which that element is first introduced. For example, element 210 is first introduced and discussed with reference to FIG. 2.

Figure 2:
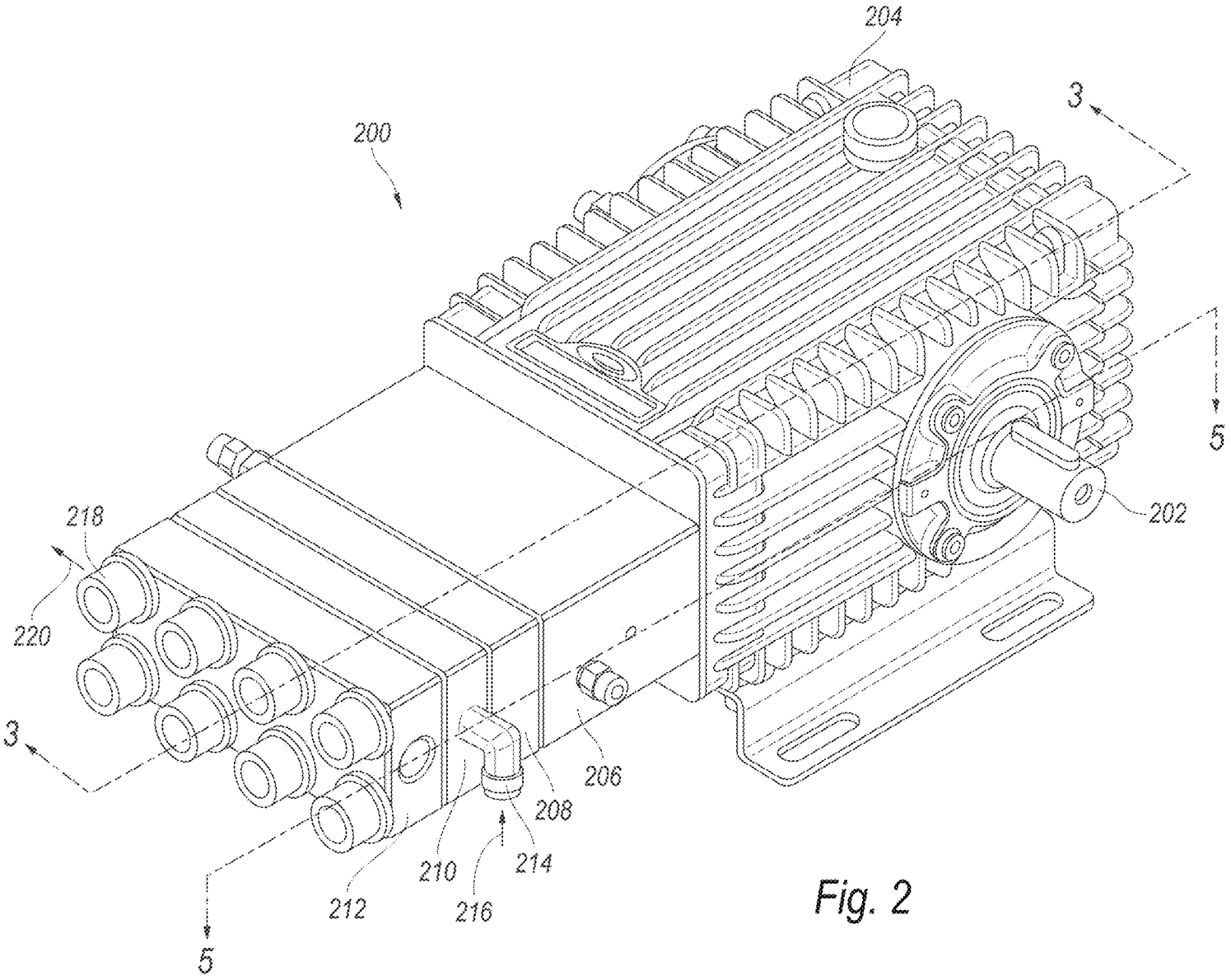
FIG. 2 is an isometric view of a high pressure direct drive pump configured in accordance with an embodiment of the present technology.

FIG. 2 is an isometric view of a high pressure pump 200 configured in accordance with an embodiment of the present technology. In the illustrated embodiment, the pump 200 is a high pressure direct drive pump (e.g., a three cylinder pump) that can be used with, for example, fluid-jet cutting systems (e.g., waterjet or abrasive-jet systems). The pump 200 includes a crankshaft 202 that is rotatably mounted in a crankcase 204. The crankshaft 202 can be operably coupled to a drive system (not shown), such as an internal combustion engine, electric motor, etc. in a conventional manner. In contrast to conventional high pressure multi-cylinder pumps in which multiple sets of individual components are associated with each cylinder (see, e.g., the pump 100 of FIG. 1A), the pump 200 consolidates many of the individual components into a single assembly. For example, in the illustrated embodiment, the pump 200 includes a single cylinder manifold assembly 208 that is mounted to the crankcase 204 by means of an adapter block 206. Similarly, the pump 200 further includes a single check valve manifold assembly 210 that is mounted to the cylinder manifold assembly 208, and a single outlet manifold assembly 212 that is similarly mounted to the check valve assembly manifold 210. The manifolds 208, 210 and 212 are fixedly attached to the adapter block 206 (which in turn is bolted to the crankcase 204) by means of a plurality of fasteners 218 (e.g., bolts). Together the manifolds carry the "wet end" components (e.g., cylinders, check valve assemblies, etc.) of all three of the pump cylinders.

As described in greater detail below, in operation an inlet fitting 214 introduces relatively low pressure liquid (e.g., water; indicated by arrow 216) into the check valve manifold assembly 210. As the drive system rotates the crankshaft 202, the downward movement of corresponding plungers (not shown) draws or otherwise allows the low pressure liquid to flow from the check valve manifold assembly 210 into corresponding compression chambers (not shown) in the cylinder manifold assembly 208. The subsequent upward movement of the plungers then pressurizes the liquid and drives it out of the compression chambers via the check valve manifold assembly 210. From there, the high pressure liquid flows into the outlet manifold assembly 212 and then out of the pump 200 via an outlet (not shown) on the outlet manifold assembly 212, as indicated by arrow 220.

Figure 3:
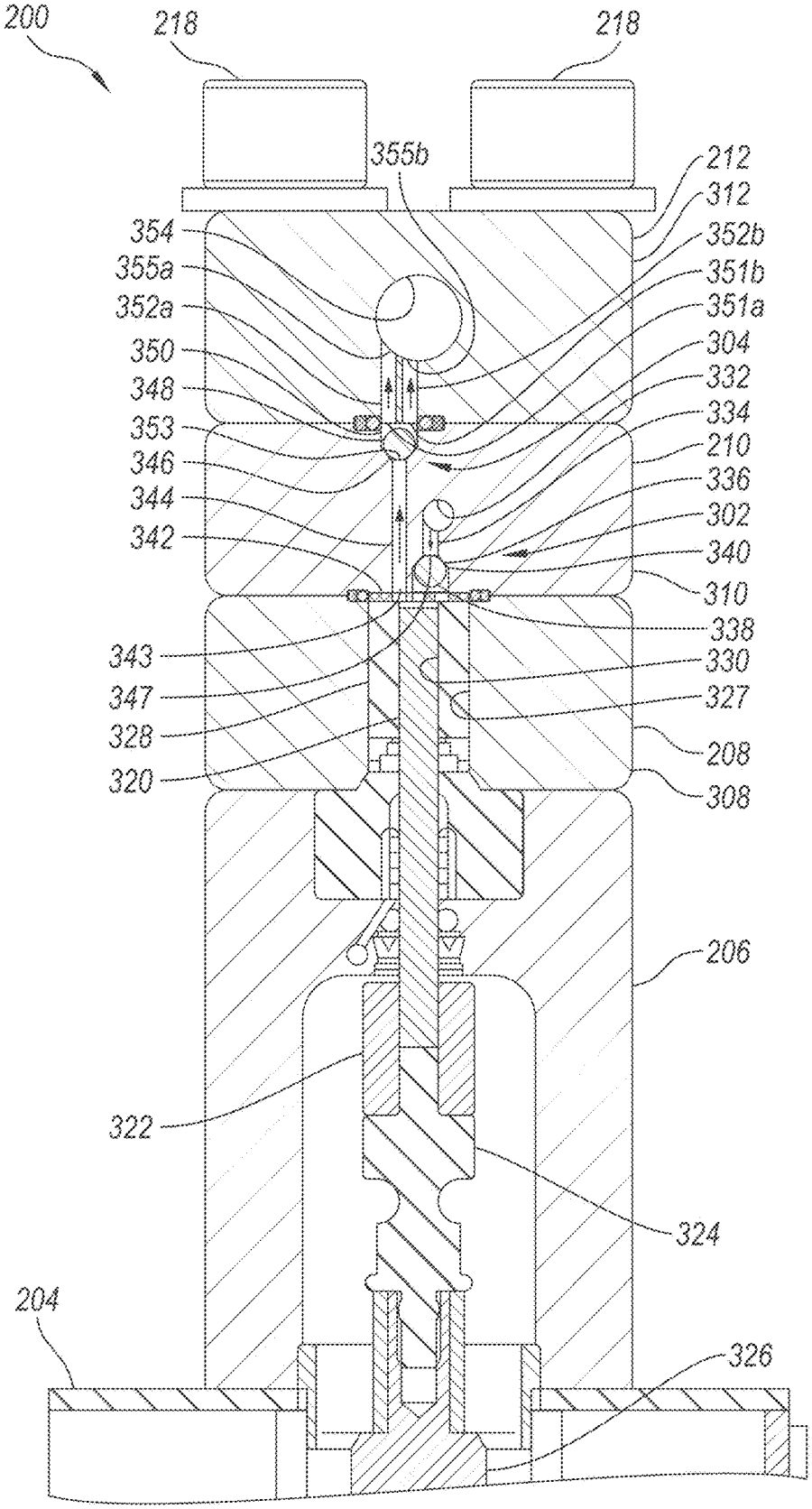
FIG. 3 is an enlarged cross-sectional view of the pump of FIG. 2 taken substantially along line 3-3 in FIG. 2.

FIG. 3 is an enlarged cross-sectional view taken substantially along line 3-3 in FIG. 2 illustrating various components of the wet end of the pump 200 configured in accordance with an embodiment of the present technology. In the illustrated embodiment, the cylinder manifold assembly 208 includes a cylinder manifold 308 having a cylindrical bore 327 that houses a liquid displacer 328. The liquid displacer 328 has a corresponding cylindrical bore 330 that receives a reciprocating plunger rod 320 ("plunger 320"). The plunger 320 is shown in FIG. 3 at or near a top dead center (TDC) position, however, it will be appreciated that the plunger 320 reciprocates between the TDC position shown and a bottom dead center (BDC) position in which the plunger 320 is retracted to a lower position within the cylindrical bore 330. The plunger 320 is operably coupled to a pony rod 324 by an adapter sleeve 322. The pony rod 324 is coupled to a crosshead 326 which is operably coupled to the crankshaft 202 (FIG. 2) and configured to reciprocate in response to rotation thereof in a conventional manner.

In the illustrated embodiment, the check valve manifold assembly 210 includes a check valve manifold 310 having an inlet check valve assembly 302 and an outlet check valve assembly 304. The inlet check valve assembly 302 includes an inlet check ball 338 movably positioned within an inlet check ball cavity 340. The check ball cavity 340 includes a ball seat 336 (e.g., an annular beveled surface) that surrounds an inlet orifice 347. The inlet orifice 347 is in fluid communication with a main liquid inlet passage 332 by means of an inlet branch passage 334. As described in greater detail below, in one aspect of the illustrated embodiment the inlet check ball 338 is operably retained in the check ball cavity 340 during operation of the pump 200 by a keeper 342 (e.g., a perforated keeper plate) that is held between a lower surface of the check valve manifold 310 and an opposing upper surface of the liquid displacer 328.

The outlet check valve assembly 304 includes an outlet check ball 348 that is operably positioned in an outlet check ball cavity 350. The outlet check ball cavity 350 includes a check ball seat 346 (e.g., a beveled annular surface) that extends around an inlet orifice 353. The inlet orifice 353 is in direct fluid communication with an outlet orifice 343 on the opposite side of the check valve manifold 310 by means of an outlet branch passage 344. In the illustrated embodiment, the outlet check ball 348 and the outlet check ball cavity 350 can be identical, or at least substantially similar, in shape, size, material, etc. as the inlet check ball 338 and the inlet check ball cavity 340, respectively.

In the illustrated embodiment, the outlet manifold assembly 212 includes an outlet manifold 312 having a plurality of outlet branch passages 352 (identified individually as a first outlet branch passage 352*a* and a second outlet branch passage 352*b*) that convey high pressure liquid from the outlet check ball cavity 350 to a main liquid outlet passage 354. More specifically, in the illustrated embodiment, each of the outlet branch passages 352 includes a corresponding outlet orifice 351 (identified individually as a first outlet orifice 351*a* and a second outlet orifice 351*b*) which open directly into the outlet check ball cavity 350. Additionally, each of the outlet branch passages 352 further includes a corresponding inlet orifice 355 (identified individually as a first inlet orifice 355*a* and a second inlet orifice 355*b*) which open directly into the main outlet passage 354. As described in greater detail below, in one aspect of the illustrated embodiment the surface portions of the outlet manifold 312 in the immediate proximity of the outlet orifices 351 operably retain the outlet check ball 348 in the outlet check ball cavity 350 during operation of the pump 200.

Figure 4A:
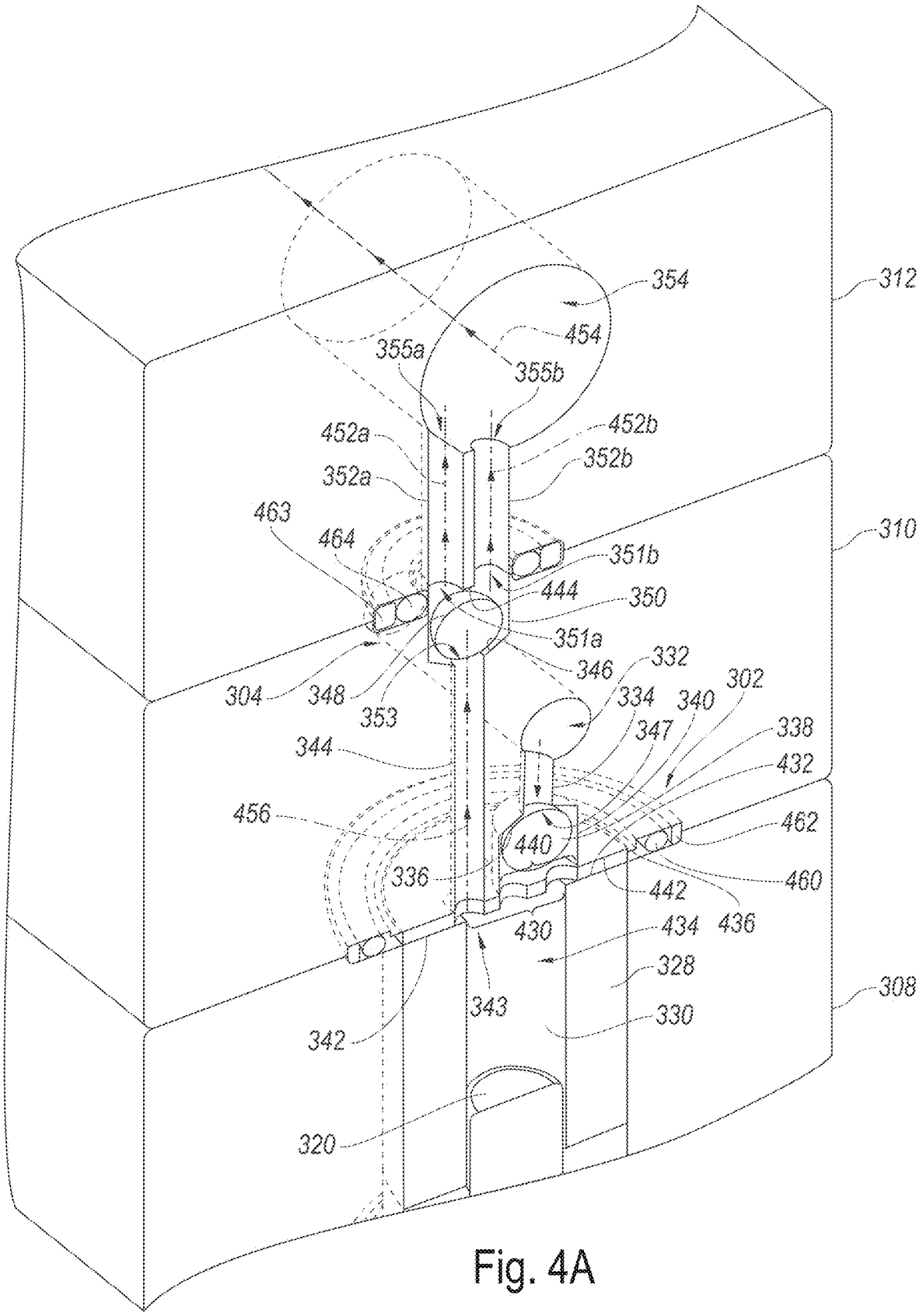
FIG. 4A is an enlarged cross-sectional isometric view of the wet end of the pump of FIG. 2, FIGS. 4B and 4C are exploded isometric views of a check valve keeper assembly and a check valve outlet assembly, respectively.
Figure 4C:
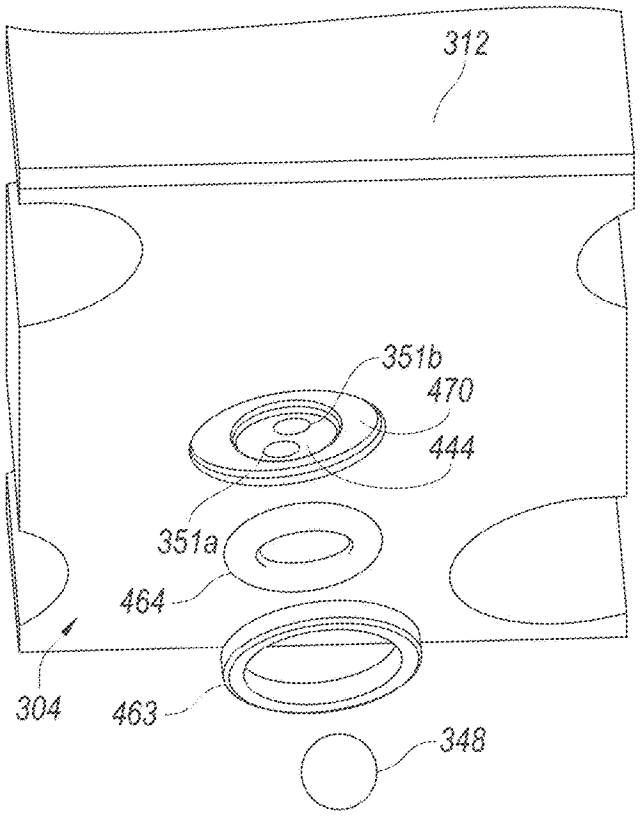
FIG. 4D is an enlarged cross-sectional isometric view of the pump of FIG. 2 having a keeper with a single hole to permit fluid to flow through the ball cavity and into the first opening, and to permit fluid to flow from the first opening into the outlet orifice, configured in accordance with embodiments of the present technology.
Figure 4B:
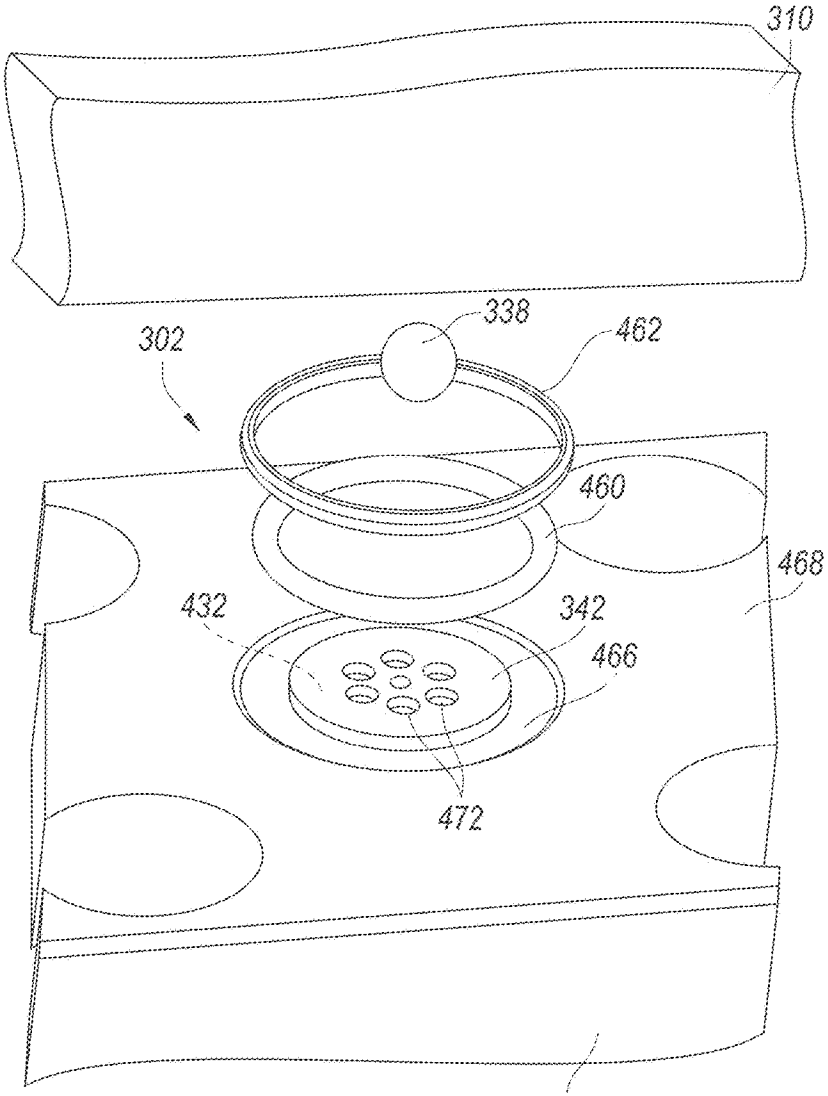

FIG. 4A is an enlarged isometric view of a portion of the cross-section shown in FIG. 3, and FIGS. 4B and 4C are exploded, top front and bottom front isometric views of portions of the inlet check valve assembly 302 and the outlet check valve assembly 304, respectively, configured in accordance with embodiments of the present technology. Referring first to FIG. 4A, in the illustrated embodiment the plunger 320 is retracted in the cylindrical bore 330 away from the keeper 342. The top surface of the plunger 320 and the sidewalls of the cylindrical bore 330 at least partially define a compression chamber 434. The liquid displacer 328 includes a first surface portion 432 (e.g., an annular surface portion) that surrounds an opening 430 into the compression chamber 434. The check valve manifold 310 includes an opposing second surface portion 442 (e.g., an annular surface portion) that extends around the outlet orifice 343 and an opening 440 into the check ball cavity 340. In one aspect of this embodiment, the keeper 342 is held in position by the first surface portion 432 on one side of the keeper 342, and the opposing second surface portion 442 on the other side of the keeper 342. More specifically, the keeper 342 can be held in position by trapping or capturing the keeper 342 in the space between the first surface portion 432 and the opposing second surface portion 442. Additionally, the keeper 342 can be generally centered over the opening 430 and restricted from lateral movement by a peripheral lip 436 that extends around the second surface portion 442 of the check valve manifold 310. As the foregoing description illustrates, the keeper 342 is held in position without reliance on any threaded parts which, as noted above, can fatigue and fail over time as a result of the constant high pressure cycling experienced by the pump 200.

Although the keeper 342 is held between the liquid displacer 328 and the check valve manifold 310 in the illustrated embodiment, in other embodiments the keeper 342 and various embodiments thereof can be held in position by other opposing surfaces in the same manner as taught herein. For example, in those embodiments in which a high pressure pump may not include a liquid displacer in the cylinder, the keeper 342 and various embodiments thereof can be held in position as taught herein by opposing surfaces of the cylinder manifold and the check valve manifold that extend around the opening to the compression chamber.

Figure 4D:
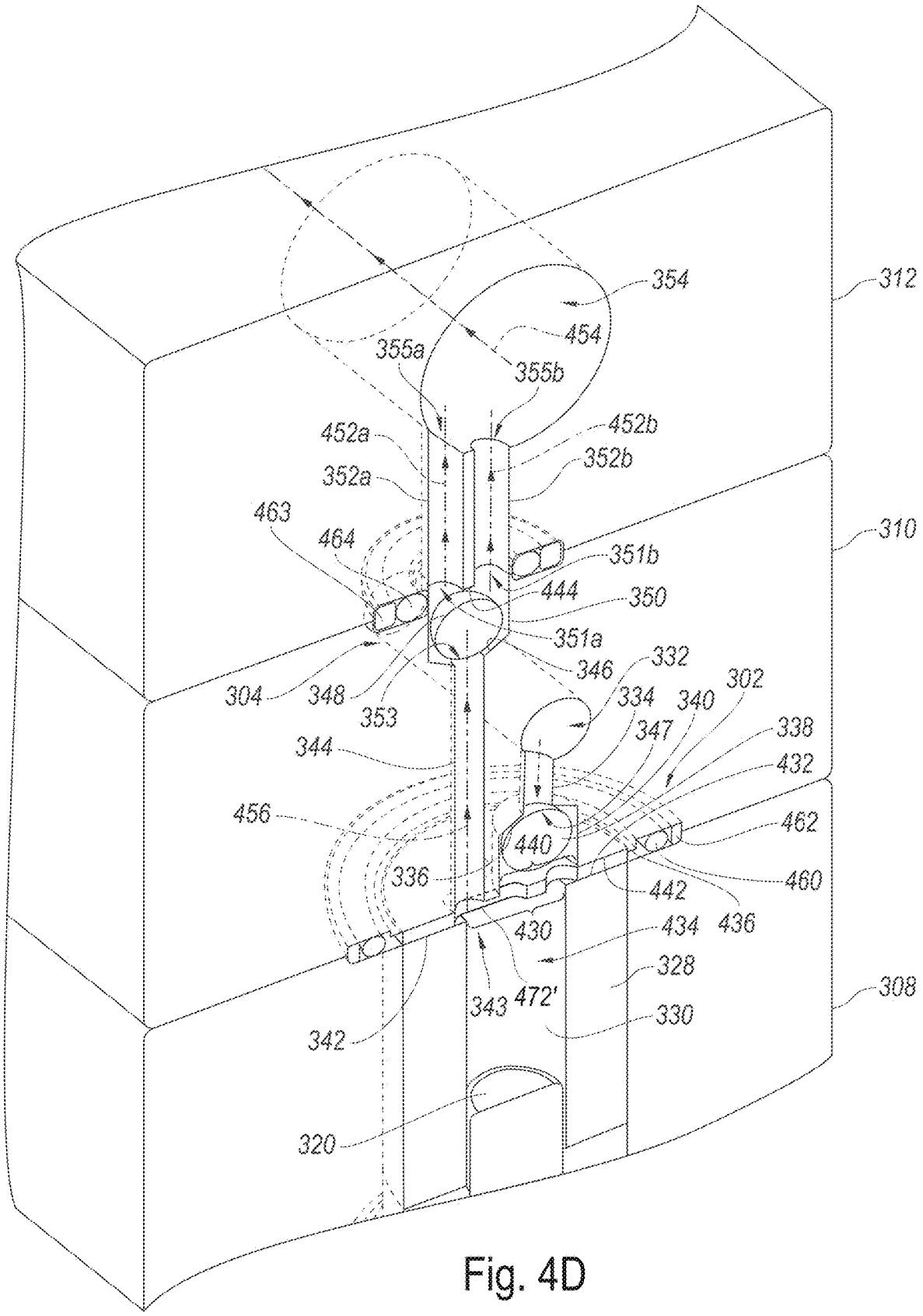

As can be seen by reference to FIG. 4B, in the illustrated embodiment the keeper 342 is a flat plate with a circular shape having a plurality of through holes 472 formed therein. In some embodiments, the keeper 342 can be manufactured from stainless steel plate having a thickness of from about 0.01 inch to about 0.1 inch, or about 0.036 inch. Although the keeper 342 includes six or more holes 472 in the illustrated embodiment, in other embodiments the keeper 342 can include more or fewer holes and can have other configurations without departing from the present disclosure. In some embodiments, the pump 200 can further include an O ring 460 and a seal 462 which are concentrically positioned around the keeper 342 in a recess 466 formed in a mating surface 468 of the cylinder manifold 308. In operation, the O ring 460 and the seal 462 are compressed between the adjacent surfaces of the cylinder manifold 308 and the check valve manifold 310 to prevent high pressure liquid from escaping the compression chamber 434 during operation of the pump 200. Referring to FIG. 4D, in some embodiments the keeper 342 can include a single through hole or slot 472' to permit fluid to flow through the ball cavity 340 and into the first opening 430, and to permit fluid to flow from the first opening 430 into the outlet orifice 343.

Referring next to FIG. 4C, the outlet manifold 312 includes a surface portion 444 that surrounds the outlet orifices 351. As described in greater detail below, the surface portion 444 operably retains the outlet check ball 348 in the outlet check ball cavity 350 (FIG. 4A). The outlet check valve assembly 304 can further include an O-ring 464 and a seal 463 that are concentrically positioned in a recess 470 which is formed around the outlet orifices 351 in the surface portion 444. In operation, the O-ring 464 and the seal 463 are operably compressed between the opposing surface portions of the recess 470 and the check valve manifold 310 that extends around the outlet check ball cavity 350 (FIG. 4A).

Referring to FIGS. 3-4C together, as noted above, in the illustrated embodiment the pump 200 is a three cylinder high pressure direct drive pump. Accordingly, although the foregoing components have been described with reference to a single cylinder, it will be appreciated that the other two cylinders of the pump 200 include identical, or at least substantially similar, components as the components described above and the components are arranged and operate in the same manner. Moreover, although the pump 200 is a three cylinder direct drive high pressure pump, the structures and systems described herein are not limited to use with such pumps. Accordingly, the keeper 342 and other structures and systems described herein can be used with a wide variety of other fluid pressurizing systems including, for example, direct drive high pressure pumps having more or less than three cylinders, low pressure pumps operating at, e.g., outlet pressures of 7,500 psi or less, pumps that use pistons instead of plungers, etc.

Additionally, it should be noted that in the illustrated embodiment the cylinder manifold 308, the check valve manifold 310 and the outlet manifold 312 are "unitary structures." As used herein, the term unitary structure refers to a structure (e.g., a manifold) that is formed from and embodied in a single, integral piece of material, such as a single metal casting, forging, etc. For example, in some embodiments the cylinder manifold 308, the check valve manifold 310 and the outlet manifold 312 can each be machined from a single metal casting. Accordingly, to provide the three cylinder pump of the illustrated embodiment, the cylinder manifold 308 includes three cylindrical bores 327, the check valve manifold 310 includes three inlet check ball cavities 340 and three outlet check ball cavities, and the outlet manifold 312 includes three sets of the first and second outlet branch passages 352. Consolidating three sets of individual parts into three unitary manifolds substantially reduces the part count and simplifies the assembly of the pump 200 as compared to conventional multi-cylinder high pressure direct drive pumps, such as the pump 100 described above with reference to FIGS. 1A-C.

Returning to FIG. 4A, in operation the plunger 320 draws relatively low pressure liquid into the compression chamber 434 as it moves downwardly and away from the keeper 342. More specifically, downward motion of the plunger 320 reduces the pressure on the backside of the inlet check ball 338, enabling it to move away from the ball seat 336 and allow liquid to flow into the check ball cavity 340 from the main inlet passage 332 via the inlet branch passage 334 and the inlet orifice 347. This liquid travels past the inlet check ball 338 and into the compression chamber 434 via the holes 472 in the keeper 342. As the plunger 320 changes direction and moves upwardly in the compression chamber 434, it compresses the liquid in the compression chamber 434 and the adjoining open volumes in the inlet check ball cavity 350 and the outlet branch passage 344. The increased pressure drives the inlet check ball 338 into the ball seat 336 to prevent any high pressure fluid from flowing out of the compression chamber 434 via the inlet orifice 347. Once the pressure of the liquid in the outlet branch passage 344 is sufficient to overcome the pressure of the liquid on the backside of the outlet check ball 348, the liquid in the outlet branch passage 344 drives the outlet check ball 348 away from the seat 346, allowing the high pressure liquid from the compression chamber 434 to flow into the main outlet passage 354 via the outlet orifices 351 and the corresponding outlet branch passages 352.

As the foregoing illustrates, during operation of the high pressure pump 200, the keeper 342 retains the inlet check ball 338 in the inlet check ball cavity 340 without requiring any threaded structures that could be susceptible to fatigue cracking and other degradation from high pressure cycling. Similarly, by using a plurality (e.g., two) outlet passage orifices 351 with the outlet check valve assembly 304 that are each smaller than the outlet check ball 348, the outlet check ball 348 is retained in the outlet check ball cavity 350 by the surface portion 444 of the outlet manifold 312 without the need for threaded retainers and the multiple parts often associated with conventional high pressure pump systems.

In a further aspect of the illustrated embodiment, each of the outlet branch passages 352 is aligned with a corresponding central axis 452, and the main outlet passage 354 is aligned with a central axis 454 that is oriented perpendicularly relative to the central axes 452. It will be noted that the central axes 452 are parallel to each other and also parallel to a central axis 456 of the outlet check ball cavity 350 and the outlet branch passage 344. It will also be noted that the inlet orifices 355 in the main outlet passage 354 are aligned in a transverse direction (i.e., a circumferential direction) that is perpendicular to the central axis 454 of the main outlet passage 354. In one aspect of this embodiment, the principal stresses in the manifold material surrounding the main outlet passage 354 are tangential to the main outlet passage 354. As a result, aligning the inlet orifices 355 in this direction (i.e., perpendicular to the central axis 454) has been found to reduce the local stresses around the inlet orifices 355 in excess of 30% in some embodiments, and further reduce the susceptibility of the outlet manifold 312 to the fatigue stress that would otherwise be present if the inlet orifices were instead aligned in a direction parallel to the central axis 454.

Figure 5:
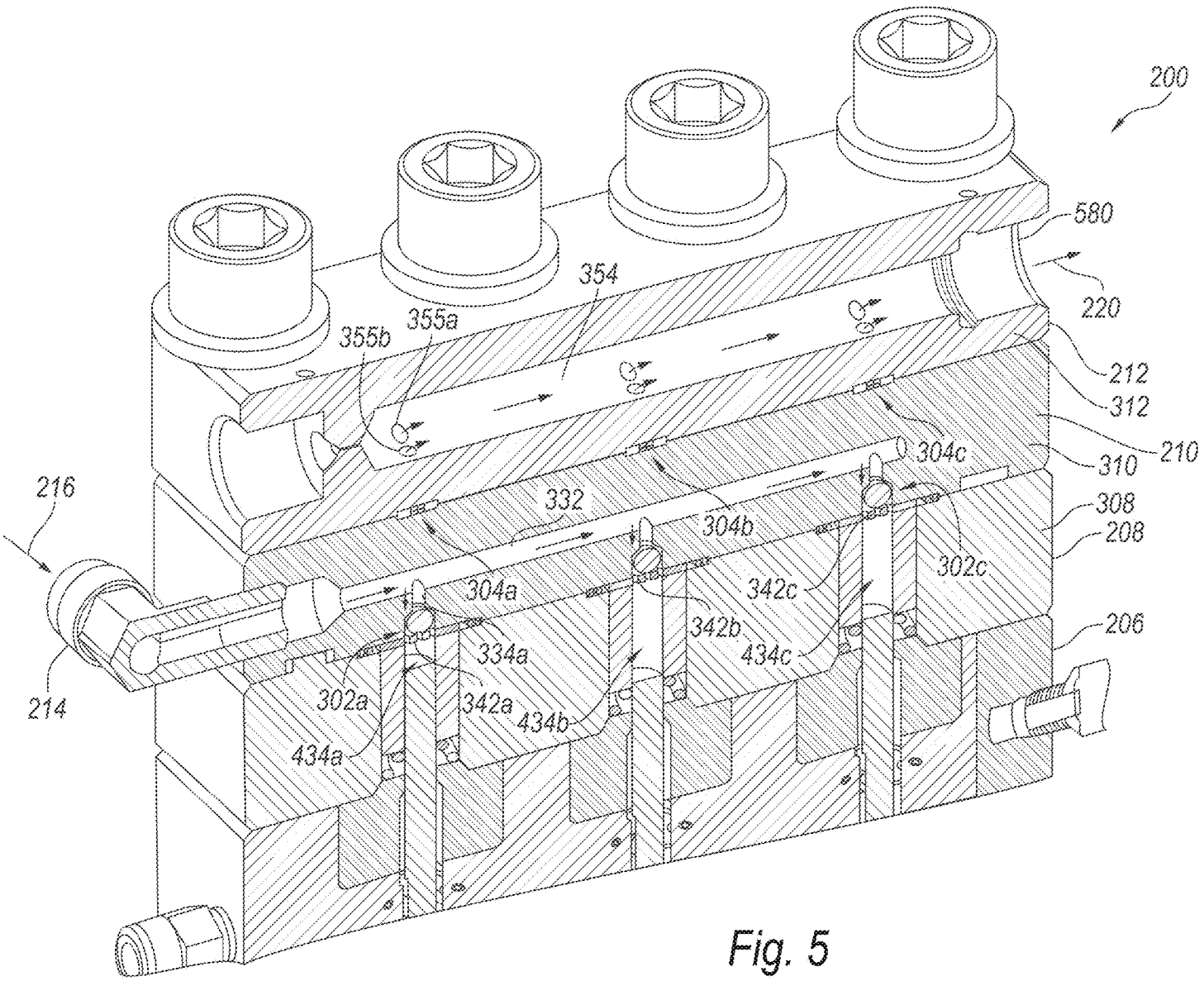
FIG. 5 is a cross-sectional isometric view of the pump of FIG. 2 taken substantially along line 5-5 in FIG. 2.

FIG. 5 is a cross-sectional isometric view of the pump 200 taken substantially along line 5-5 in FIG. 2. As this view illustrates, the cylinder manifold 308 is a unitary structure comprising three compression chambers 434 (identified individually as compression chambers 434*a*-*c*), and the check valve manifold 310 is similarly a unitary structure with provisions for the main inlet passage 332, three inlet check valve assemblies 302 (identified individually as inlet check valve assemblies 302*a*-*c*), and three outlet check valve assemblies 304 (identified individually as outlet check valve assemblies 304*a*-*c*; see FIG. 4A). Similarly, the outlet manifold 312 is also a unitary structure with provisions for the three outlet check valve assemblies 304*a*-*c* and the main outlet passage 354.

As described above, in operation, rotation of the crankshaft 202 (FIG. 2) causes reciprocation of the plungers 320 in their respective compression chambers 434. The resulting downward movement (i.e. retraction) of the plungers 320 in the respective compression chambers 434 draws liquid (e.g., water) into the compression chambers 434 via the main inlet passage 332 and the associated inlet branch passages 334 and inlet check valve assemblies 302. The corresponding upward movement (i.e., extension) of the plungers 320 into the respective compression chambers 434 compresses the liquid (to, e.g., pressures greater than 10,000 psi, such as pressures ranging from about 10,000 psi to about 120,000 psi, pressures ranging from about 30,000 psi to about 120,000 psi, or pressures ranging from about 60,000 psi to about 120,000 psi) and drives it into the main outlet passage 354 via the outlet branch passages 344, and the corresponding outlet check valves assemblies 304 and outlet branch passages 352*a* and 352*b* (FIG. 4). From the main outlet passage 354, the high pressure fluid flows out of the pump 200 via a high pressure outlet 580.

As will be appreciated by those of ordinary skill in the art, the pump 200 requires substantially less parts than conventional high pressure direct drive pumps (e.g., the pump 100 described above with reference to FIGS. 1A-C). Moreover, the pump 200 does not use threaded assemblies to retain check valve components and, as a result, has a substantially longer service life than conventional pump assemblies which are more prone to early failure due to fatigue stress from high pressure cycling. Another advantage of some embodiments of the pump 200 as compared to, for example, conventional low pressure pumps (e.g., pressure washer pumps which operate up to around 4,000 psi), is that low pressure pumps having unitary structures typically have cross-drilled holes in areas exposed to high pressure cycling at high frequencies. For example, some low pressure pumps have cross-drilled holes in or near the cylinder for introducing fluid into the compression chamber. Other low pressure pumps have cross-drilled holes for this purpose in the outlet passage leading to the outlet check valve. While cross-drilled holes may be acceptable in the pressurizing regions of low pressure pumps, such holes can lead to premature fatigue stress failure as pressures increase to 30,000 psi and higher. As can be seen by reference to, for example, the embodiments of FIGS. 3 and 4A, the pump 200 avoids this problem by not having any cross-drilled holes in the high pressure/high cycle regions of the pump. More specifically, the passages exposed to high pressure fluid and high frequency pressure cycles in these embodiment of the pump 200 (e.g., the inlet check ball cavity 340 and the outlet branch passage 344) do not have any cross-drilled holes. A further limitation of low pressure pumps is associated with the relatively large size of the dead volume in the high pressure region. At relatively low pressures (e.g., about 4,000 psi) the compressibility of water is not an issue, but at higher pressures (e.g., 30,000 psi or more) the compressibility of water becomes an issue. More specifically, as the compressibility of water increases, the output of a pump can be greatly reduced if the dead volume is too large because the pump compresses and decompresses the water in the high pressure region like a spring and, as a result, little water flows out. In contrast to conventional low pressure pumps, embodiments of the pump 200 described above address this issue by having relatively small dead volumes.

Figure 6:
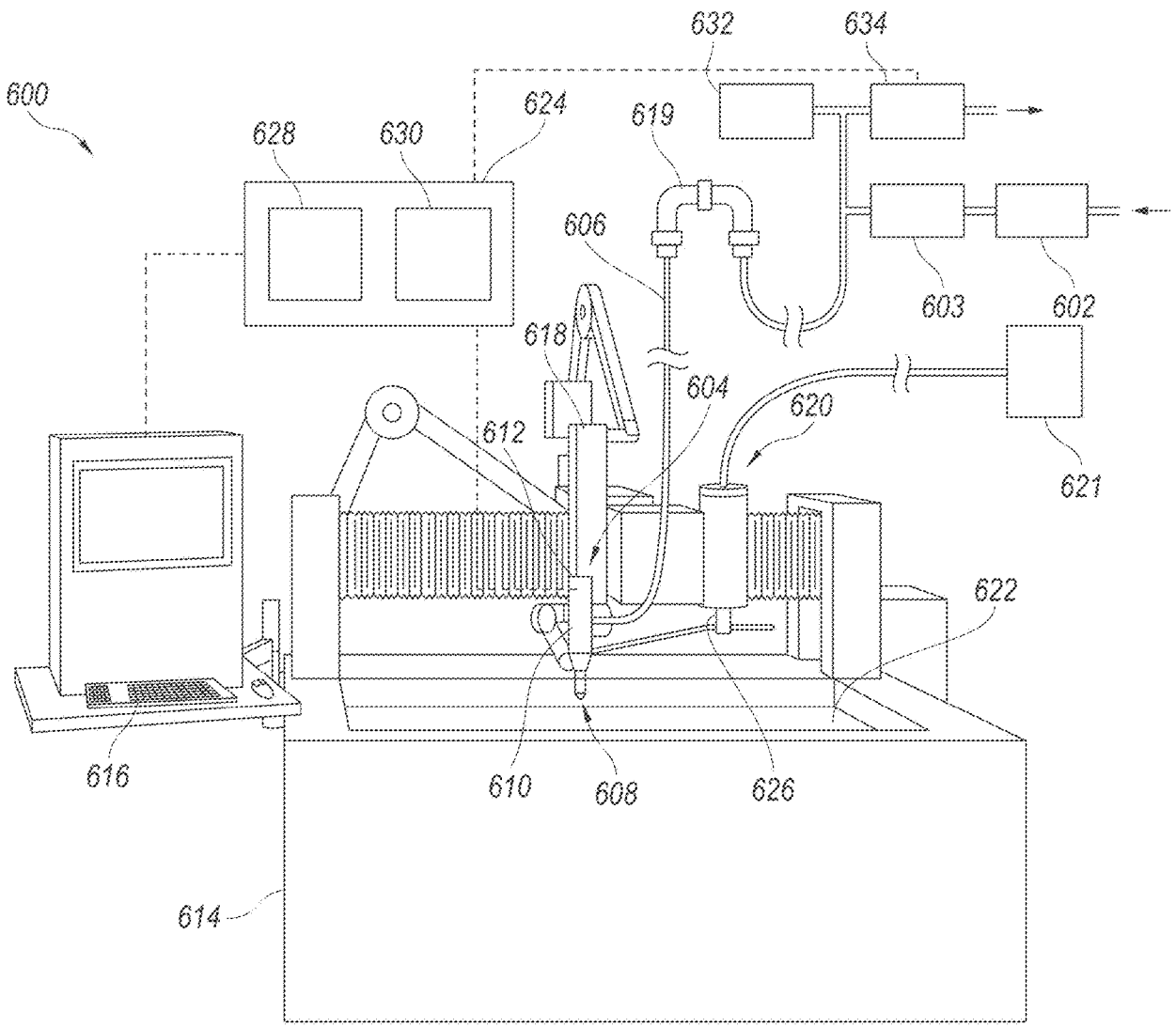
FIG. 6 is a partially schematic perspective view of a waterjet system including a high pressure pump configured in accordance with an embodiment of the present technology.

FIG. 6 is a perspective view of a waterjet system 600 configured in accordance with an embodiment of the present technology. The waterjet system 600 includes a fluid-pressurizing device 602 (shown schematically) configured to pressurize a fluid (e.g., water) to a pressure suitable for waterjet processing. In some embodiments, the fluid-pressurizing device 602 can be a direct drive pump that is at least generally similar in structure and/or function to the pump 200 described in detail above with reference to FIGS. 2-5. The fluid-pressurizing device 602 can be configured to discharge the high pressure fluid into a manifold 603. The waterjet system 600 can further include a waterjet assembly 604 operably connected to the fluid-pressurizing device 602 via a conduit 606 extending between the manifold 603 and the waterjet assembly 604. In the illustrated embodiment, the conduit 606 is also connected in fluid communication to a safety valve 632 and a relief valve 634.

The waterjet assembly 604 can include a control valve 610 upstream from a jet outlet 608. The control valve 610 can be at least generally similar in structure and/or function to one or more of the control valves described in U.S. Pat. No. 8,904,912, titled "CONTROL VALVES FOR WATERJET SYSTEMS AND RELATED DEVICES, SYSTEMS, AND METHODS," which is incorporated herein by reference in its entirety. For example, the control valve 610 can be configured to receive fluid from the fluid-pressurizing device 602 via the conduit 606 at a pressure suitable for waterjet processing (e.g., a pressure greater than 30,000 psi) and to selectively reduce the pressure of the fluid as the fluid flows through the control valve 610 toward the jet outlet 608. For example, in some embodiments the waterjet assembly 604 can include a first actuator 612 configured to control the position of a pin (not shown) within the control valve 610 and thereby selectively reduce the pressure of the fluid.

The waterjet system 600 can further include a user interface 616 supported by a base 614, and a second actuator 618 configured to move the waterjet assembly 604 relative to the base 614 and other stationary components of the system 600 (e.g., the fluid-pressurizing device 602). For example, the second actuator 618 can be configured to move the waterjet assembly 604 along a processing path (e.g., cutting path) in two or three dimensions and, in at least some cases, to tilt the waterjet assembly 604 relative to the base 614. The conduit 606 can include a joint 619 (e.g., a swivel joint or another suitable joint having two or more degrees of freedom) configured to facilitate movement of the waterjet assembly 604 relative to the base 614. Thus, the waterjet assembly 604 can be configured to direct a jet including the fluid toward a workpiece (not shown) supported by the base 614 (e.g., held in a jig supported by the base 614) and to move relative to the base 614 while directing the jet toward the workpiece.

The system 600 can further include an abrasive-delivery apparatus 620 configured to feed particulate abrasive material from an abrasive material source 621 to the waterjet assembly 604 (e.g., partially or entirely in response to a Venturi effect associated with a fluid jet passing through the waterjet assembly 604). Within the waterjet assembly 604, the particulate abrasive material can accelerate with the jet before being directed toward the workpiece through the jet outlet 608. In some embodiments the abrasive-delivery apparatus 620 is configured to move with the waterjet assembly 604 relative to the base 614. In other embodiments, the abrasive-delivery apparatus 620 can be configured to be stationary while the waterjet assembly 604 moves relative to the base 614. The base 614 can include a diffusing tray 622 configured to hold a pool of fluid positioned relative to the jig so as to diffuse kinetic energy of the jet from the waterjet assembly 604 after the jet passes through the workpiece.

The system 600 can also include a controller 624 (shown schematically) operably connected to the user interface 616, the first actuator 612, the second actuator 618, and the relief valve 634. In some embodiments, the controller 624 is also operably connected to an abrasive-metering valve 626 (shown schematically) of the abrasive-delivery apparatus 620. In other embodiments, the abrasive-delivery apparatus 620 can be without the abrasive-metering valve 626 or the abrasive-metering valve 626 can be configured for use without being operably associated with the controller 624. The controller 624 can include a processor 628 and memory 630 and can be programmed with instructions (e.g., non-transitory instructions contained on a computer-readable medium) that, when executed, control operation of the system 600. For example, the controller 624 can control operation of the control valve 610 (via the first actuator 612) in concert with operation of the relief valve 634 to decrease the pressure of fluid downstream from the control valve 610 while the pressure of fluid upstream from the control valve remains relatively constant.

Figure 7A:
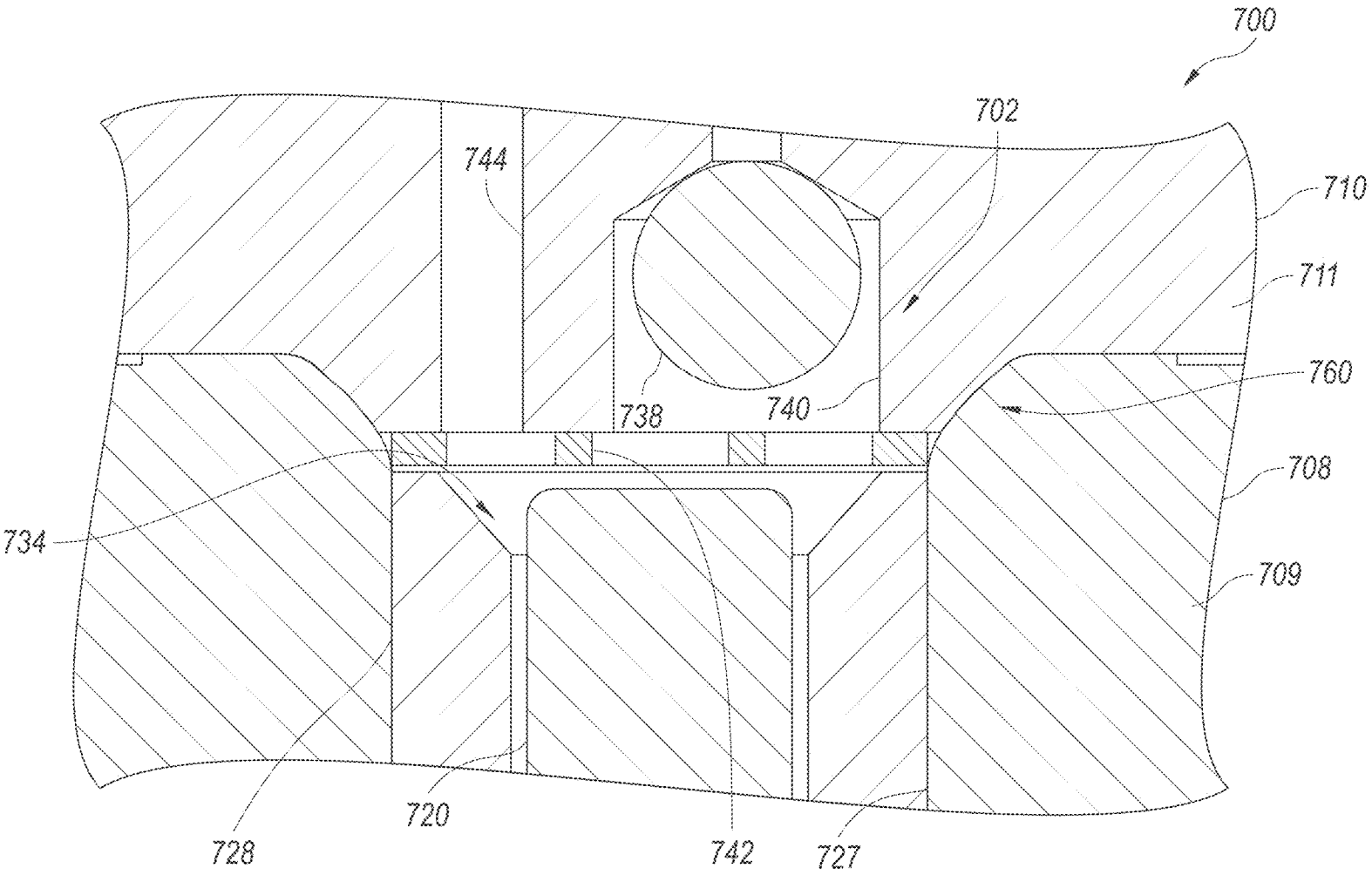
FIG. 7A is an enlarged cross-sectional view of a portion of a high pressure pump having a metal-to-metal seal configured in accordance with an embodiment of the present technology.
Figure 7B:
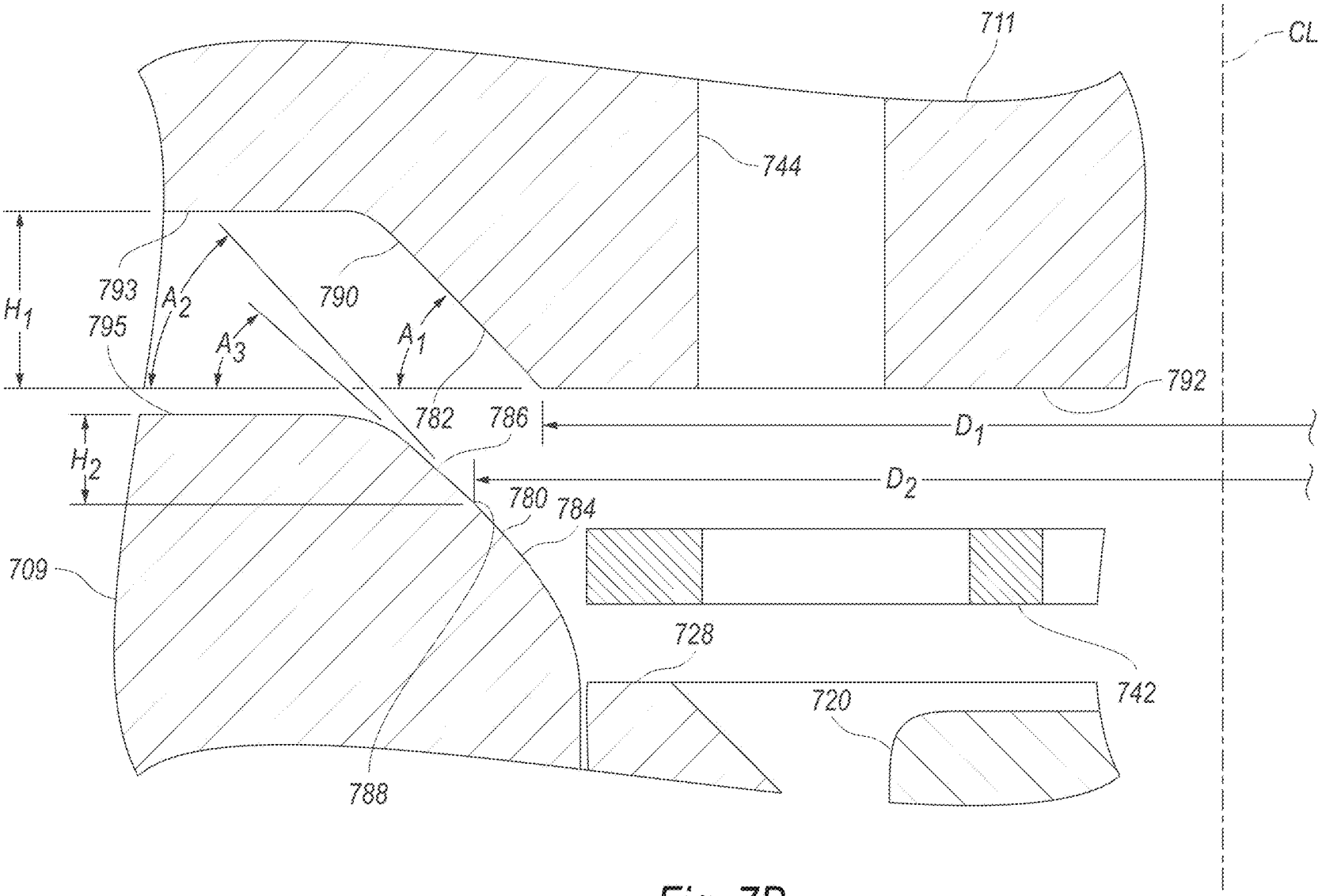
FIG. 7B is an exploded cross-sectional view of a portion of the metal-to-metal seal shown in FIG. 7A.

FIG. 7A is an enlarged cross-sectional view, and FIG. 7B is an exploded cross-sectional view, of a portion of a pump 700 having a metal-to-metal seal 760 configured in accordance with an embodiment of the present technology. The pump 700 can be at least generally similar in structure and function to the high pressure pump 200 described in detail above with reference to FIGS. 2-5. For example, the pump 700 includes a check valve manifold assembly 710 that is bolted or otherwise operably mounted to a cylinder manifold assembly 708. Like the check valve manifold assembly 210 described above, the check valve manifold assembly 710 can include a check valve manifold 711 that includes a check valve cavity 740 and a corresponding outlet branch passage 744. An inlet check ball 738 is positioned in the check valve cavity 740 to form an inlet check valve assembly 702. The cylinder manifold assembly 708 can include a cylinder manifold 709 having a cylindrical bore 727 that houses a liquid displacer 728 which at least partially defines a compression chamber 734. A perforated keeper 742 is operably disposed between the check valve manifold assembly 710 and the cylinder manifold assembly 708 to operably retain the inlet check ball 738 in the check ball cavity 740. As with the pump 200 described above, the pump 700 includes a plunger 720 that reciprocates within the liquid displacer 728 to draw fluid into the compression chamber 734 via the check valve assembly 702, compress the fluid, and then drive the fluid out of the compression chamber 734 via the outlet branch passage 744.

Based on the description above, it can be seen that the check valve manifold assembly 710, the cylinder manifold assembly 708, the keeper 742 and the other associated components of the pump 700 are at least generally similar in structure and function to the corresponding components of the pump 200 described in detail above with reference to FIGS. 2-5. Accordingly, in some embodiments the check valve manifold 711 can be formed from a unitary structure having a plurality (e.g., three) inlet check valve assemblies 702 and corresponding outlet branch passages 744, and the cylinder manifold 709 can be a unitary structure that includes a plurality (e.g., three) of the cylindrical bores 727 and corresponding compression chambers 734. Alternatively, in other embodiments high pressure pumps having metal-to-metal seals configured in accordance with the present technology can utilize separate, individual cylinders for each of the compression chambers 734, instead of utilizing a single unitary structure (e.g., the cylinder manifold 709) having multiple cylinders formed therein. Accordingly, the metal-to-metal seals described in detail below can be used with a high pressure pump having a single, unitary cylinder manifold (as with the pump 200 described above) or with high pressure pumps using individual cylinders for each of the compression chambers.

In the illustrated embodiment, check valve manifold 711 includes a boss 782 extending from a first base surface portion 793, and the cylinder manifold 709 includes a recess 780 formed in an opposing second base surface portion 795. It should be noted that in other embodiments, the boss 782 can be formed on the cylinder manifold 709 and the recess 780 can be formed in the check valve manifold 711. As described in greater detail below, when the check valve manifold 711 is bolted or otherwise mounted to the cylinder manifold 709 so that the first surface portion 793 is in direct contact with (or in near contact with) the second surface portion 795, there is an interference fit between the boss 782 and the recess 780. This interference fit causes the interfering metal surfaces of boss 782 and the recess 780 to deform slightly as the two manifolds 709 and 711 are clamped together, thereby forming the metal-to-metal seal 760.

More specifically, in the illustrated embodiment the boss 782 includes a first conical surface portion 790 extending between the first base surface portion 793 and an end surface portion 792. The first conical surface portion 790 is disposed at a first angle $A_1$ relative to the second base surface portion 795, and the end surface portion 792 has a first diameter $D_1$ and a first height $H_1$. By way of example only, in the illustrated embodiment the first angle $A_1$ can be from about 20 degrees to about 60 degrees, or about 45 degrees; the first diameter $D_1$ can be from about 0.25 inch to about 1.5 inches, or from about 0.4 inch to about 1 inch, or about 0.648 inch; and the first height $H_1$ can be from about 0.03 inch to about 0.25 inch, or from about 0.04 inch to about 0.15 inch, or about 0.0875 inch.

In the illustrated embodiment, the recess 780 includes a second conical surface portion 784 and a third conical surface portion 786. The second conical surface portion 784 can be disposed at a second angle $A_2$ relative to the second base surface portion 795, and the third conical surface portion 786 can be disposed at a third angle $A_3$ relative to the second base surface portion 795. The second angle $A_2$ can be from about 30 degrees to about 60 degrees, or about 48 degrees, and the third angle $A_3$ can be from about 30 degrees to about 60 degrees and less than the second angle $A_2$, such as about 42 degrees. As a result, the second and third angled surface portions 784, 786 meet in a circular line that defines a slight crown or ridge 788 extending around the recess 780. In the illustrated embodiment, the ridge 788 can have a second diameter $D_2$ of from about 0.3 inch to about 2 inches, or from about 0.5 inch to about 1 inch, or about 0.723 inch. Additionally, the ridge 788 can be located at a second height $H_2$ below the second base surface portion 795. The second height $H_2$ can be from about 0.01 inch to about 1 inch, or from about 0.02 inch to about 0.08 inch, or about 0.045 inch.

When the check valve manifold assembly 710 is installed on the cylinder manifold assembly 708, the relative sizing of the boss 782 and the recess 780 creates interference between at least the ridge 788 and the first conical surface portion 790. As the fasteners (e.g., the bolts 218 of FIG. 2; not shown) that fixedly attach the check valve manifold assembly 710 to the cylinder manifold assembly 708 are tightened, this interference results in slight deformation of the contacting metal surfaces of the ridge 788 and the first conical surface portion 790. This creates a metal-to-metal seal that prevents high pressure fluid from escaping the compression chamber 734 during pump operation without requiring other sealing devices such as, for example, the O-ring 460 or the seal 462 described above with reference to FIGS. 4A-4C. Accordingly, the metal-to-metal seal 760 of the present embodiment further simplifies construction of high pressure pumps by eliminating additional high pressure seals around compression chambers and between adjacent manifold assemblies.

As will be appreciated by those of ordinary skill in the art, although the boss 782 is formed on the check valve manifold 711 and the recess 780 is formed in the cylinder manifold 709 in the illustrated embodiment, in other embodiments, the positions of the boss 782 and the recess 780 can be reversed. More specifically, in other embodiments a metal-to-metal seal around the compression chamber 734 can be formed by metal-to-metal contact between a boss formed on the cylinder manifold 709 and a recess formed in the check valve manifold 711. Additionally, it will be appreciated that in other embodiments, the metal-to-metal seal 760 described herein can be used in high pressure pumps having conventional inlet check valves that lack the keeper 742, such as the inlet check valve 122*a* described above with reference to FIGS. 1B and 1C. Accordingly, the high pressure metal-to-metal seal 760 described herein is not limited to use with any particular high pressure pump configuration. The manifolds and other structures described herein can be manufactured from any suitable materials, including various suitable metal materials, using any suitable methods known in the art. For example, in some embodiments, the cylinder manifold 709 and the check valve manifold 711 can be manufactured (e.g., machined) from a stainless steel, such as 15-5, 17-4, Nitronic 60, Carpenter Custom 455, and/or other stainless steels. In other embodiments, these parts can be made from other suitable metals using various suitable methods known in the art.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. Accordingly, this disclosure and associated technology can encompass other embodiments not expressly shown or described herein. In some cases, well-known structures and functions have not been shown or described in detail to avoid unnecessarily obscuring the description of embodiments of the present technology. Although steps of methods may be presented herein in a particular order, in alternative embodiments, the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology.

It should be noted that other embodiments in addition to those disclosed herein are within the scope of the present technology. For example, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology.

Certain aspects of the present technology may take the form of computer-executable instructions, including routines executed by a controller or other data processor. In some embodiments, a controller or other data processor is specifically programmed, configured, or constructed to perform one or more of these computer-executable instructions. Furthermore, some aspects of the present technology may take the form of data (e.g., non-transitory data) stored or distributed on computer-readable media, including magnetic or optically readable or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps. The methods disclosed herein include and encompass, in addition to methods of making and using the disclosed apparatuses and systems, methods of instructing others to make and use the disclosed apparatuses and systems.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

References throughout the foregoing description to features, advantages, or similar language do not imply that all of the features and advantages that may be realized with the present technology should be or are in any single embodiment of the invention. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment.

From the foregoing, it will be appreciated that specific embodiments of the invention have been described herein for purposes of illustration, but that various modifications may be made without deviating from the spirit and scope of the various embodiments of the invention. Accordingly, the invention is not limited, except as by the appended claims. Although certain aspects of the invention may be presented below in certain claim forms, the applicant contemplates the various aspects of the invention in any number of claim forms. Accordingly, the applicant reserves the right to pursue additional claims after filing this application to pursue such additional claim forms.

We claim:

1. A high pressure pump system, comprising:

a first assembly having a first opening therein, a first surface adjacent the first opening and having a first face parallel to and adjacent the first surface;

a second assembly having a second opening therein, a second surface adjacent the second opening and having a second face parallel to and adjacent the second surface, wherein the second assembly is operably positioned against the first assembly with the second face in contact with the first face, and wherein the second opening at least partially defines a ball cavity, the ball cavity including— an inlet orifice; and a ball seat disposed around the inlet orifice;

a ball disposed in the ball cavity, wherein the ball is operable to move into the ball seat and prevent fluid from flowing through the ball cavity and into the inlet orifice; and a keeper that operably retains the ball within the ball cavity, wherein the keeper is disposed between the first opening and the second opening and is retained by contact with the first and second surfaces, and wherein the keeper includes at least one hole to permit fluid to flow through the ball cavity and into the first opening.

2. The high pressure pump of claim 1 wherein the keeper is a flat plate.

3. The high pressure pump of claim 1 wherein movement of the keeper is only restricted by contact with the first and second assemblies.

4. The high pressure pump of claim 1 wherein the keeper lacks threads for threadably engaging the keeper with either the first or second assemblies.

5. The high pressure pump of claim 1 wherein:

the first surface extends around the first opening; and the second surface extends around the second opening.

6. The high pressure pump of claim 1 wherein:

the second assembly further includes an outlet orifice adjacent to the second opening;

the keeper is disposed between the outlet orifice and the first opening; and the at least one hole in the keeper permits fluid to flow from the first opening into the outlet orifice.

7. The high pressure pump of claim 6 wherein:

the first surface extends around the first opening;

the second surface extends around the second opening and the outlet orifice.

8. The high pressure pump of claim 1 wherein:

the first assembly includes a fluid displacer, the fluid displacer having the first opening and a first surface portion extending around the first opening;

the second assembly includes a second surface portion extending around the second opening; and the keeper is sandwiched between the first and second surface portions.

9. The high pressure pump of claim 1 wherein the first opening at least partially defines a compression chamber in the first assembly, wherein the compression chamber is in fluid communication with the ball cavity, and wherein the high pressure pump further comprises a reciprocating member operably disposed in the compression chamber.

10. The high pressure pump of claim 9 wherein operation of the reciprocating member pressurizes liquid in the compression chamber to a pressure from 10,000 psi to 120,000 psi.

11. The high pressure pump of claim 1 wherein:

the first opening at least partially defines a compression chamber in the first assembly; and the second assembly further includes an outlet orifice adjacent to the second opening, wherein the keeper is disposed between the outlet orifice and the compression chamber, and wherein the at least one hole in the keeper permits low pressure fluid to flow from the ball cavity into the compression chamber, and permits high pressure fluid to flow from the compression chamber into the outlet orifice.

12. The high pressure pump of claim 1 wherein:

the first assembly further includes a third opening;

the second assembly includes a unitary structure having the second opening formed therein, the ball cavity is a first ball cavity formed in the unitary structure, the inlet orifice is a first inlet orifice, and the ball seat is a first ball seat;

the unitary structure further includes— a fourth opening at least partially defining a second ball cavity having a second inlet orifice and a second ball seat disposed around the second inlet orifice; and a main inlet passage in fluid communication with the first inlet orifice and the second inlet orifice;

the ball is a first ball and the keeper is a first keeper; and the high pressure pump further includes— a second ball disposed in the second ball cavity, wherein the second ball is operable to move into the second ball seat and prevent fluid from flowing through the second ball cavity and into the second inlet orifice; and a second keeper that operably retains the second ball within the second ball cavity, wherein the second keeper is disposed between the third opening and the fourth opening and retained by the first and second assemblies, and wherein the second keeper includes at least one hole to permit fluid to flow through the second ball cavity and into the fourth opening.

13. The high pressure pump of claim 1 wherein:

the first assembly includes a recess, the second assembly includes a boss that extends into the recess, the first opening is disposed in the recess, and the second opening is disposed in the boss.

14. The high pressure pump of claim 13 wherein:

the recess includes a first surface portion, the boss includes a second surface portion, and the first surface portion makes direct metal-to-metal contact with the second surface portion to form a metal-to-metal seal between the first assembly and the second assembly.

15. The high pressure pump of claim 13 wherein:

the recess includes a circular surface portion, the boss includes a conical surface portion, and the circular surface portion makes direct metal-to-metal contact with the conical surface portion to form a metal-to-metal seal between the first assembly and the second assembly.

16. The high pressure pump of claim 13 wherein the boss and the recess are sized to create an interference fit when the second assembly is operably positioned against the first assembly.

17. The high pressure pump of claim 1, further comprising a wall between the first surface and the second surface, wherein the keeper is in contact with the wall.

18. The high pressure pump of claim 17 wherein the wall is a peripheral lip.

19. The high pressure pump of claim 1 wherein the keeper is positioned between the ball cavity and the first assembly.

20. The high pressure pump of claim 1 wherein the keeper forms a boundary of and is positioned outside the ball cavity.

* * * * *